US006328173B1

(12) United States Patent
Wimmer

(10) Patent No.: US 6,328,173 B1
(45) **Date of Patent: *Dec. 11, 2001**

(54) CRANE

(75) Inventor: Erich Wimmer, Eggelsberg (AT)

(73) Assignee: Palfinger Aktiengesellschaft, Bergheim (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,404

(22) Filed: Aug. 26, 1999

(30) Foreign Application Priority Data

Sep. 8, 1998 (EP) ..... 98116951

(51) Int. Cl.[7] ..... B66C 13/40
(52) U.S. Cl. ..... 212/278; 212/261
(58) Field of Search ..... 212/278, 261, 212/238; 91/361

(56) References Cited

U.S. PATENT DOCUMENTS

| | | | | |
|---|---|---|---|---|
| 4,815,614 | * | 3/1989 | Putkonen et al. | 212/146 |
| 5,184,699 | * | 2/1993 | Aoki et al. | 414/631 |
| 5,257,177 | * | 10/1993 | Bach et al. | 414/699 |
| 5,305,681 | * | 4/1994 | Deivier et al. | 91/361 |
| 5,307,631 | * | 5/1994 | Tatsumi et al. | 60/452 |
| 5,383,390 | * | 1/1995 | Lukich | 91/361 |
| 5,421,155 | * | 6/1995 | Hirata et al. | 60/426 |
| 5,433,076 | * | 7/1995 | Sugiyama et al. | 60/426 |
| 5,442,912 | * | 8/1995 | Hirata et al. | 60/426 |
| 5,457,960 | * | 10/1995 | Morishita | 91/361 |
| 5,622,226 | | 4/1997 | Hausman et al. . | |
| 5,666,806 | * | 9/1997 | Dietz | 60/327 |
| 5,737,993 | * | 4/1998 | Cobo et al. | 91/361 |
| 5,784,945 | * | 7/1998 | Krone et al. | 91/361 |
| 5,832,730 | * | 11/1998 | Mizui | 60/469 |
| 5,857,333 | * | 1/1999 | Schmidt et al. | 91/361 |
| 5,897,287 | * | 4/1999 | Berger et al. | 414/699 |
| 5,996,341 | * | 12/1999 | Tohji | 60/421 |

FOREIGN PATENT DOCUMENTS

| | | |
|---|---|---|
| 37 19 897 | 12/1987 | (DE) . |
| 44 25 455 | 1/1996 | (DE) . |
| 44 28 691 | 2/1996 | (DE) . |
| 0 378 129 | 7/1990 | (EP) . |
| 0 454 923 | 11/1991 | (EP) . |
| 2 268 177 | 11/1975 | (FR) . |
| 95/22789 * | 8/1995 | (WO) . |
| 95/29118 | 11/1995 | (WO) . |
| 96/05543 * | 2/1996 | (WO) . |

OTHER PUBLICATIONS

Lodige, H. et al.: "Aktive Schwingungsdämpfung Für Ungefederte Arbeitsmaschinen", Ölhydraulik Und Pneumatik; Bd. 39, No. 3, Mar. 1, 1995, pp. 188–192, XP000492760.

* cited by examiner

*Primary Examiner*—Thomas J. Brahan
(74) *Attorney, Agent, or Firm*—Wenderoth, Lind & Ponack L.L.P.

(57) ABSTRACT

A crane having a hydraulically actuated jib system, at least one cylinder for actuating the jib system and an apparatus for monitoring the pressure in the cylinder, which indicates the crane loading, wherein the feed flow of hydraulic fluid to the cylinder is controllable by varying the cross-section of a valve, and a signal is produced in dependence on the variation in pressure in relation to time which is detected in the cylinder or the variation in the loading of the piston guided in the cylinder in relation to time, which signal actuates the drive for adjusting the valve cross-section in the direction of a reduction in the detected variation in pressure or loading.

3 Claims, 4 Drawing Sheets

CRANE

BACKGROUND OF THE INVENTION

The invention relates to a crane having a hydraulically actuated jib system, at least one cylinder for actuating the jib system and an apparatus for monitoring the pressure in the cylinder, which indicates the crane loading, wherein the feed flow of hydraulic fluid to the cylinder is controllable by varying the cross-section of a valve.

When moving loads, the acceleration effects which occur can cause oscillations of the carrier structure of the crane or the load carried by the crane. For example, the situation may involve oscillations in a vertical direction when a load is moved in a vertical direction, that is to say when it is raised or lowered, and that movement is stopped. Such oscillations give rise to loading peaks in the carrier structure of the crane and/or uncontrolled movements of the load.

The conventional method of actively damping undesired oscillations is a regulation effect, wherein the oscillation is damped by an oscillation of the same frequency, which is phase-shifted through 180°. The method is particularly suitable for preventing the progressive build-up of oscillaticns, for example pendulum movements of loads which are being moved, in the case of portal cranes (see DE 42 38 795 A1). The time involved in determining the phase and frequency of the harmonic oscillation causing the problems is however relatively great. In particular loadings which suddenly occur are not alleviated precisely in their dangerous initial phase.

In comparison, for example DE 37 19 897 A1 has proposed that the dynamic overloadings which most frequently occur in the case of loading cranes for goods vehicles or trucks can be combated in terms of the cause thereof. In that respect, the cause is considered to be excessively fast displacement of the control lever for the hydraulic drive of a crane member. The great difference between the reference and actual values of the speed of the crane member or the reference and actual values of the valve cross-section, Without appropriate countermeasures, would cause an excessively fast change in the valve cross-section and thus excessively great acceleration of the crane. In accordance with the known proposal therefore the control signal is filtered, and the information about the position of the control lever and thus the desired final speed of the crane member is only transmitted with a delay to the control motor for varying the valve cross-section. A disadvantage with that method is in particular that it only corrects operating errors but it does not take account of the actual dynamic conditions These however are dependent not only on the control but on the respective configuration of the crane and the load as well as environmental influences (wind, or a sudden reduction or increase in load).

SUMMARY OF THE INVENTION

The object of the invention is a crane which is provided with real regulation which at the same time acts quickly, to avoid dynamic overloads.

In accordance with the invention that is achieved in that a signal is produced in dependence on the variation in pressure in relation to time which is detected in the cylinder or the variation in the loading of the piston guided in the cylinder in relation to time, which signal actuates the drive for adjusting the valve cross-section in the direction of a reduction in the detected variation in pressure or loading.

In contrast to the known apparatuses for oscillation suppression, in which excessively abrupt control signals are filtered, the regulation according to the invention is based on the measurement of a characteristic value with respect to the dynamic crane loading, with measurement being implemented directly at the crane. It is therefore not a matter of the crane operator being corrected, but of a counteracting effect only when dynamic loadings occur which threaten to endanger the carrier structure of the crane or result in undesired load movements, by virtue of the formation of a signal which actuates the drive for adjusting the valve cross-section in the direction of a reduction in the detected variation in pressure. The signal is thus independent of the reference value of the valve cross-section, which is defines by the position of a hand lever.

As the danger to the crane is basically greater with a higher level of loading, it can preferably be provided that the strength of the signal rises over-proportionally at higher pressure values.

BRIEF DESCRIPTION OF THE DRAWINGS

Further details of the invention will be described hereinafter with reference to the drawings in which.

DETAILED DESCRIPTION OF THE INVENTION

Figure 1:
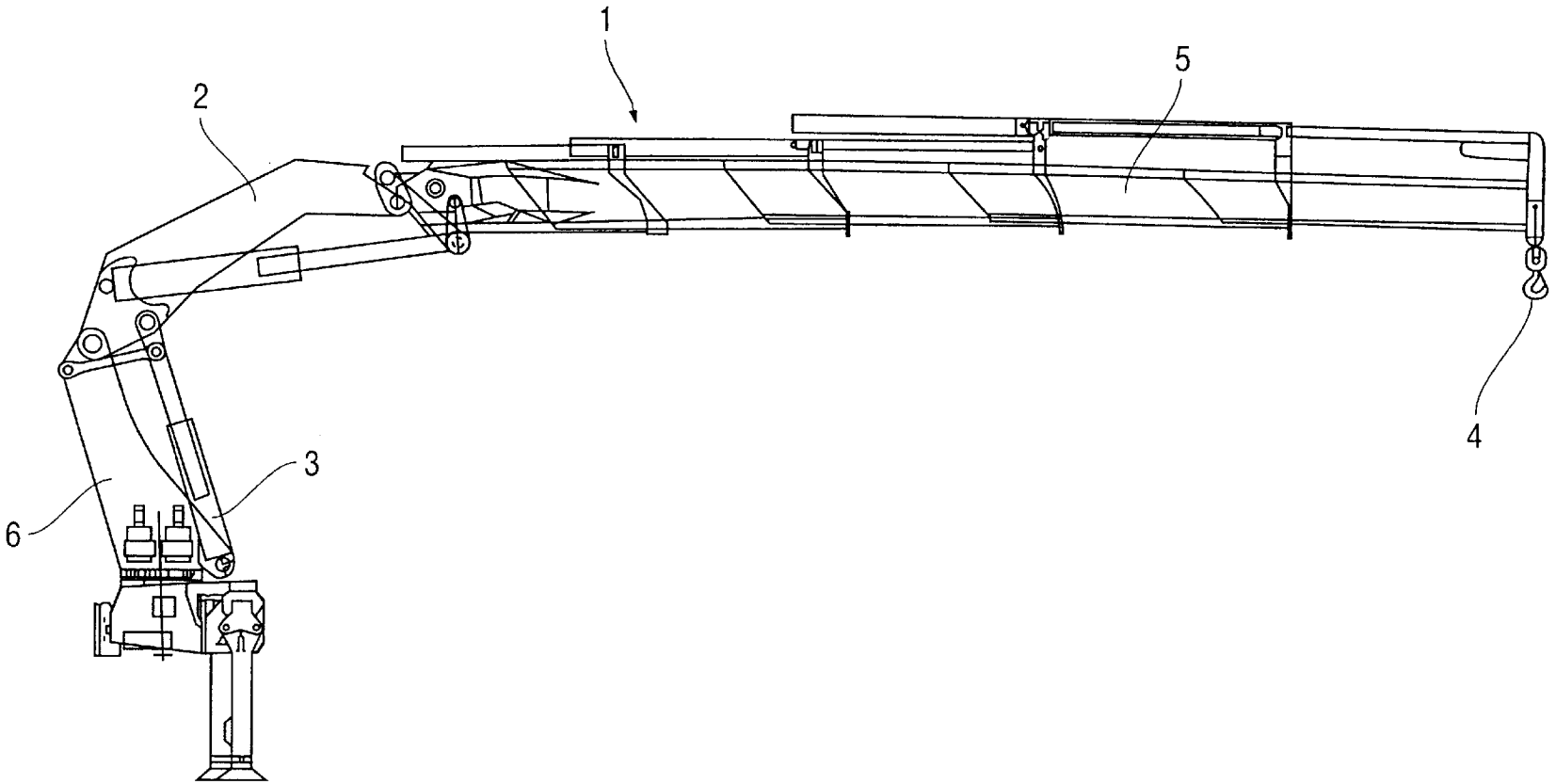
FIG. 1 shows a loading crane for a goods vehicle.

FIG. 1 shows a loading crane 1 of conventional type for a goods vehicle or truck. The crane 1 has a main arm 2 and a multiply telescopic swan neck arm 5, at the tip of which is arranged a crane hook 4 for suspending loads. The main arm 2 of the crane 1 is pivoted by means of a cylinder position assembly including a lift cylinder 3 relative to a pillar 6 of the crane 1.

As the entire load moment of the crane 1 acts on the lift cylinder 3, the latter is particularly suitable for mounting the apparatus according to the invention for oscillation suppression. It would equally be possible to envisage disposing the apparatus according to the invention at a cylinder which produces the pivotal movement of the crane jib about a vertical axis.

Figure 2:
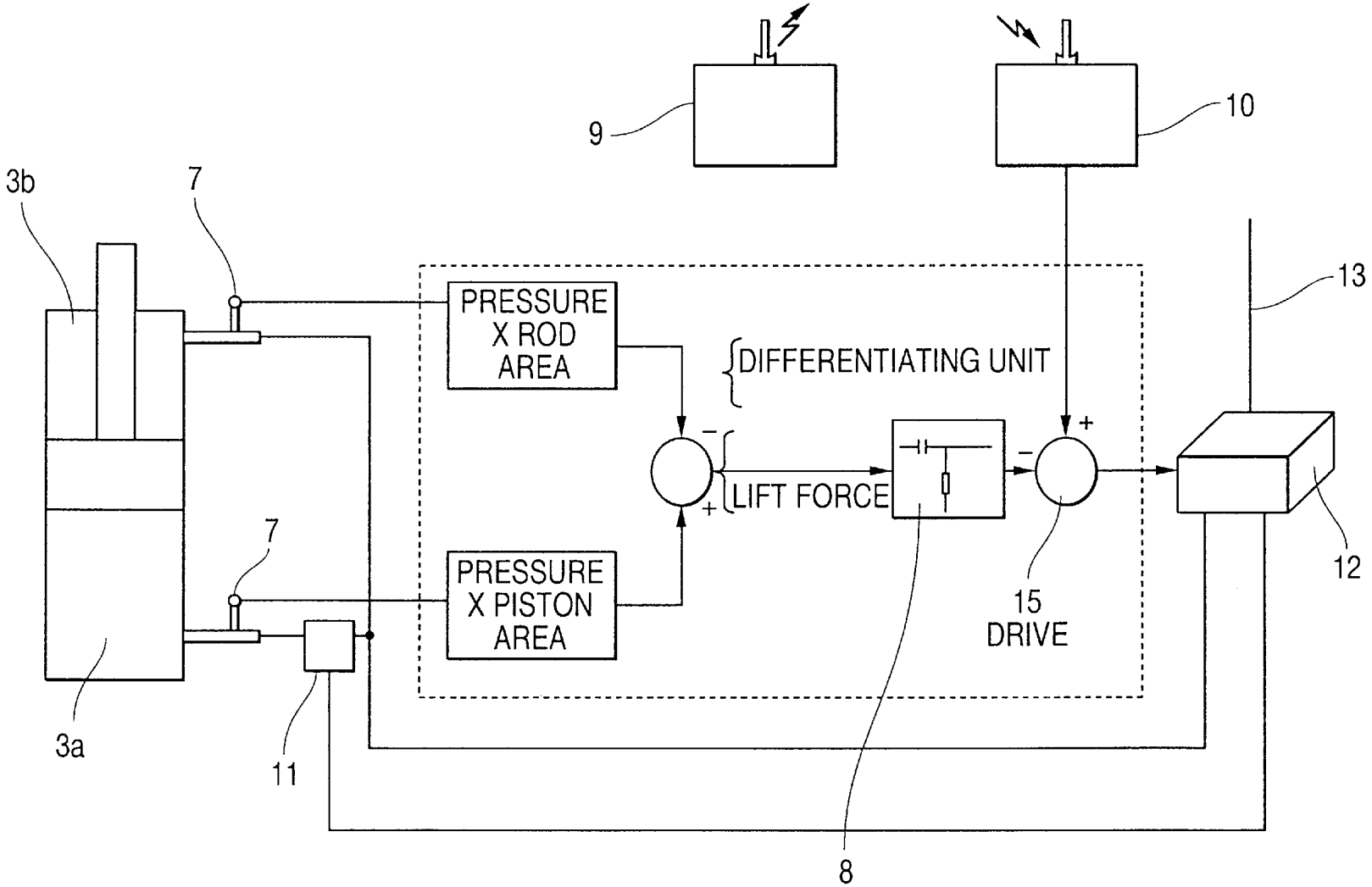
FIG. 2 shows a block circuit diagram of an apparatus according to the invention for oscillation suppression.

FIG. 2 shows the details of the apparatus according to the invention which is disposed at a cylinder, in particular the above-mentioned lift cylinder 3. Control of the lift cylinder 3 is effected by way of a commercially available remote control system comprising a transmitter 9 and a receiver 10. Control signals which originate from actuation of the control levers at the transmitter 9 are transmitted by way of radio waves to the receiver 10 which in turn passes a signal to a slide valve unit 12. The slide valve unit 12 is a multiple-proportional valve with volume control, wherein the drives for adjusting the valve cross-sections are integrated into the slide valve unit 12. A slide valve unit of that kind can be obtained for example under the designation PVG 32 from Danfoss. Depending on the respective position of the valves in the slide valve unit 12, the hydraulic oil which flows thereto by way of the pressure oil line 13 is passed in different amounts to he piston side 3*a* or the piston rod side 3*b* of the lift cylinder 3. In that case, a load-holding valve 11 is interposed on the piston side 3*a*.

A pressure pick-up or sensor 7 is disposed both on the piston side 3*a* and on the rod side 3*b*. The pressure values measured on the piston side 3*a* and the rod side 3*b*, with the piston and the rod surface areas being incorporated into the calculation, are used to calculate the resulting lift force, wherein the calculated value for the lift force is passed to a control or to a differentiating unit 8. The first derivative with respect to time, which reflects the change in pressure measured in the lift cylinder 3, is formed in the control as differentiating unit 8 from the lift force which is directly dependent on the pressure values measured on the piston side 3*a* and the rod side 3*b*. The differentiating unit 8 supplies an output signal which actuates the drive 15 for adjusting the valve cross-section in the direction of a reduction in the detected variation in pressure.

The output signal of the differentiating unit 8 can be multiplied by a factor k (p) which is dependent on the measured pressure values, thereby providing that the signal rises over-proportionally at higher pressure values. In other words, as the pressure increases, the signal from differentiating unit 8 increases, but the increase is greater than proportional to the increase in pressure. That takes into account of the fact that the danger to the carrier structures of the crane due to dynamic loadings is particularly great with an already existing high level of static basic loading.

The output signal of the differentiating unit 8 is superimposed with the signal which defines the reference position of the valves in the slide valve unit 12 and which is transmitted from the receiver 10, and then passed to the slide valve unit 12. In practical terms that superimposition means that the adjusting speed of the valves in the slide valve unit 12 and thus the acceleration of the crane jib is reduced. As only high levels of acceleration are detrimental for the crane, the production of a correction signal can be suppressed with low values with respect to dp/dt.

Figure 3:
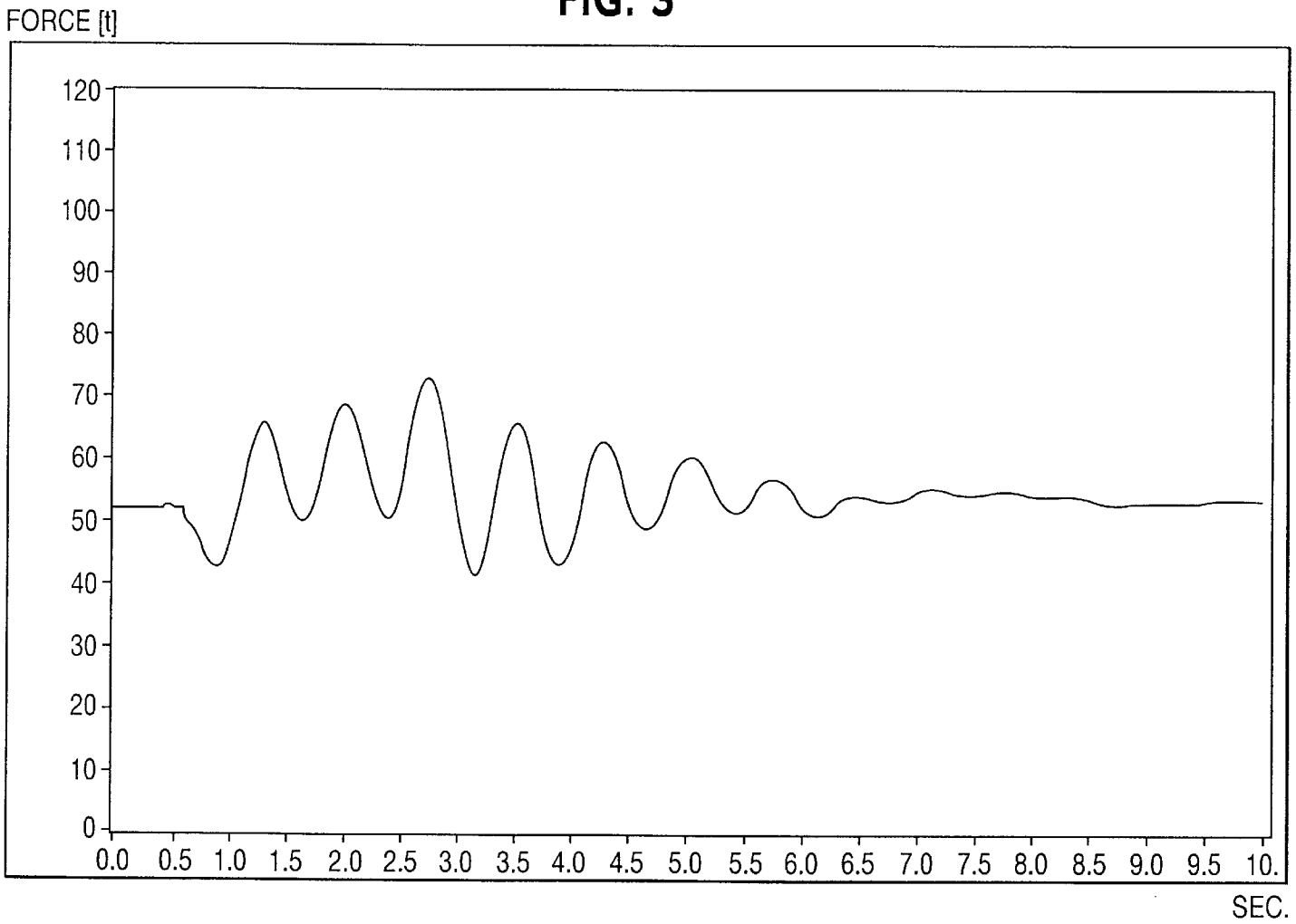
FIG. 3 shows a measurement protocol of a loading test without an apparatus according to the invention for oscillation suppression.
Figure 4:
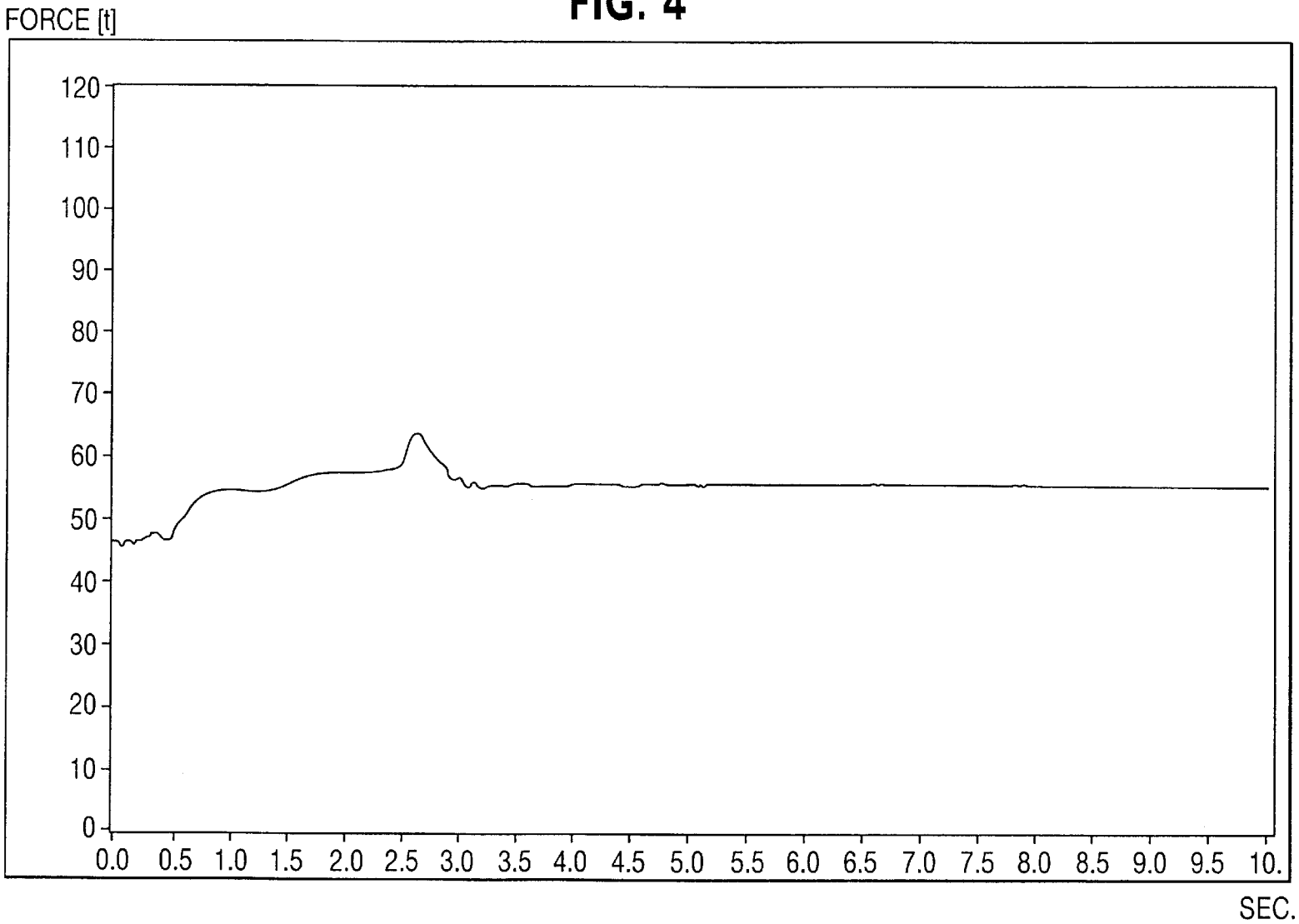
FIG. 4 shows a measurement protocol of a loading test with an apparatus according to the invention for oscillation suppression.

FIGS. 3 and 4 document the effect of the oscillation-suppressing safety apparatus according to the invention. Both measurements were carried out on the same crane under identical loading conditions, and the oscillation characteristics were measured in each case upon abruptly starting and stopping. The cylinder force resulting from piston and rod pressure oscillates in FIG. 3 (without oscillation suppression according to the invention) over a period of almost 7 seconds, of considerable amplitude, whereas the substantially lesser oscillations in FIG. 4 (with oscillation suppression according to the invention) have already died away after half that time.

What is claimed is:

1. A crane comprising:

a hydraulically actuatable jib system;

at least one cylinder-piston assembly for actuating said jib system; said cylinder-piston assembly including a cylinder a piston guided for movement in said cylinder;

a valve to regulate a feed flow of hydraulic fluid to said cylinder;

a drive to vary a cross section of said valve and thereby the feed flow;

a lever-actuated control system to produce a first control of said drive to thereby achieve a first change of said cross section of said valve;

at least one sensor to monitor pressure in said cylinder and to generate a signal representative of loading on said crane;

a control unit, operable in response to said signal, to generate an output signal representative of variation of said pressure in relation to time, and thereby of loading of said piston in said cylinder in relation to time, and to produce a second control of said drive to thereby achieve a second change of said cross section of said valve in a manner to reduce the variation of said pressure; and said first and second controls of said drive being superimposed and independent of each other.

2. A crane as claimed in claim 1, wherein at higher pressures monitored by said sensor, said control unit multiplies said output signal by a factor such that said output signal is greater than proportional to said monitored pressures.

3. A crane as claimed in claim 1, wherein said crane is a loading crane for a goods vehicle, said loading crane includes a main arm, and said cylinder-piston assembly is a lift assembly for moving said main arm.

* * * * *